United States Patent [19]

Walton

[11] Patent Number: 4,834,619

[45] Date of Patent: May 30, 1989

[54] DUCTED OSCILLATORY BLADE FAN

[75] Inventor: Thompson R. Walton, Seattle, Wash.

[73] Assignee: The Boeing Company, Seattle, Wash.

[21] Appl. No.: 119,160

[22] Filed: Nov. 10, 1987

[51] Int. Cl.[4] ..... F04B 19/00; F04B 35/04

[52] U.S. Cl. ..... 417/53; 417/322; 417/410; 417/436; 416/81

[58] Field of Search ..... 417/53, 322, 436, 410, 417/423 R, 413; 416/3, 81, 83

[56] References Cited

U.S. PATENT DOCUMENTS

| | | | |
|---|---|---|---|
| 2,928,409 | 3/1960 | Johnson et al. | 417/322 |
| 3,274,410 | 9/1966 | Boivie | 417/423 R |
| 4,063,826 | 12/1977 | Riepe | 417/436 |
| 4,171,852 | 10/1979 | Haentjens | 417/322 |
| 4,296,417 | 10/1981 | Markham et al. | 417/322 |
| 4,498,851 | 2/1985 | Kolm et al. | 417/322 |
| 4,519,751 | 5/1985 | Beckman et al. | 417/322 |
| 4,595,338 | 6/1986 | Kolm et al. | 417/322 |
| 4,648,807 | 3/1987 | Tippetts et al. | 417/322 |

FOREIGN PATENT DOCUMENTS

| | | | |
|---|---|---|---|
| 193723 | 12/1957 | Austria | 417/410 |
| 164008 | 12/1979 | Japan | 417/322 |
| 806897 | 3/1981 | U.S.S.R. | 417/322 |
| 2041447 | 9/1980 | United Kingdom | 417/410 |

OTHER PUBLICATIONS

"Solid State", p. 104, *Computer & Electronics,* Mar. 1983.

*Primary Examiner*—Donald E. Stout
*Attorney, Agent, or Firm*—Seed and Berry

[57] ABSTRACT

A duct for use with an oscillating fan blade has a preferred height which is a function of the blade height and a preferred width which is related to the maximum excursion of the blade leading edge. The duct is positioned at a preferred gap distance which is related to a maximum blade excursion distance and the velocity of the blade. A duct for a twin blade fan and a single blade fan is disclosed.

31 Claims, 3 Drawing Sheets

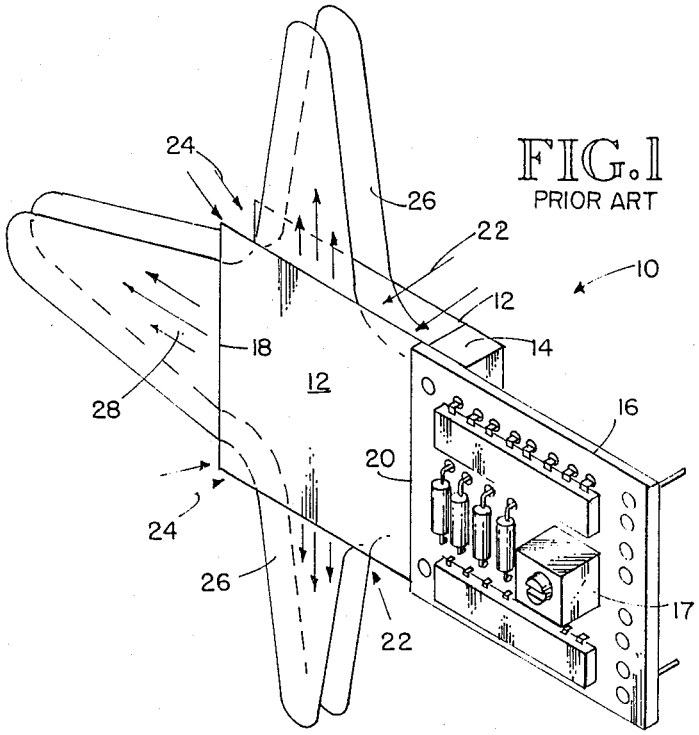
FIG. 1
PRIOR ART
FIG. 2
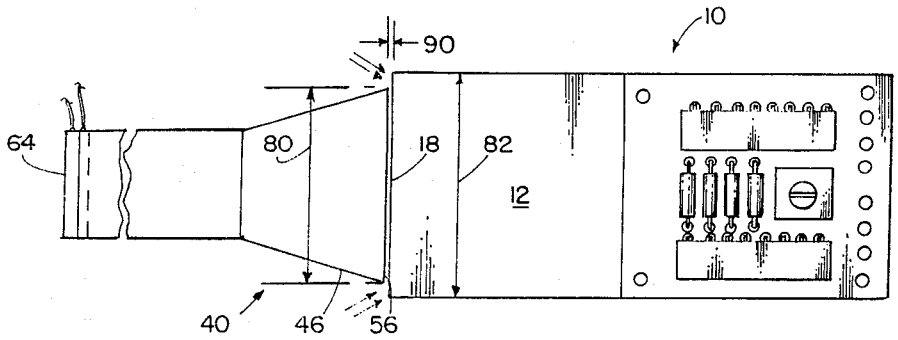

FIG. 3
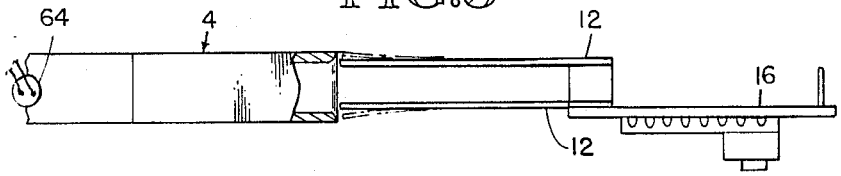
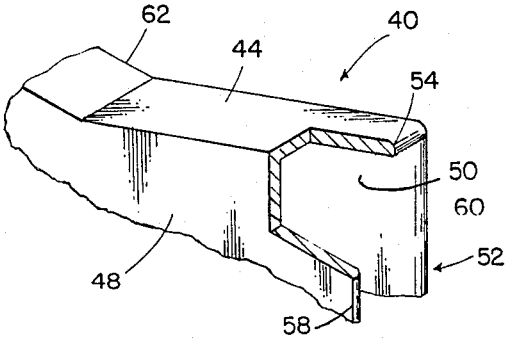
FIG. 4
FIG. 5A
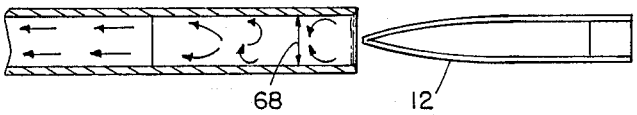
FIG. 5B
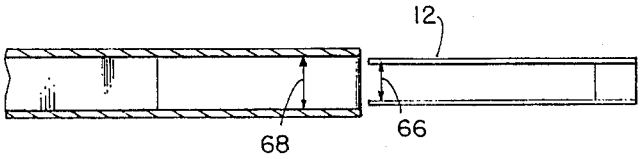
FIG. 5C
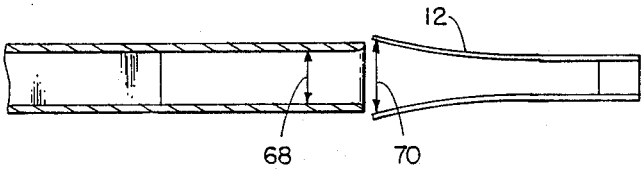

DUCTED OSCILLATORY BLADE FAN

TECHNICAL FIELD

The invention relates to cooling fans, and more specifically, to a ducted cooling fan having oscillating blades.

BACKGROUND ART

Conventional rotating fans are efficient for moving large volumes of air. However, disadvantages are associated with the use of conventional rotating fans where small volume flow rates are required, particularly when such fans are used for cooling electronic components.

The advent of solid-state oscillating fans of the type having one or more "flapping" blades provides significant advantages over conventional rotating fans. Solid-state fans of the type described typically employ a piezoelectric crystal which joins the root section of two cantilevered blades. A fan of this type is manufactured by Piezo Electric Products, Inc., Advanced Technology Group, 186 Massachusetts Avenue, Cambridge, Mass. 02139, under the model numbers LP/1200, 2400. Another type of solid-state "flapping blade fan" is described in U.S. Pat. No. 4,498,851, issued to Kolm et al. and assigned to Piezo Electric Products, Inc.

When compared to a conventional rotating fan of similar air volume output, the solid-state fan of the type described above has a number of advantages. At the same flow velocity of a conventional rotating fan, the solid state fan typically consumes approximately one-fifth the current and one-half the power while delivering approximately one-half the flow volume. The solid-state fan also generates substantially less electromagnetic interference than does the electric motor of the conventional fan. Life expectancy of a conventional fan is on the order of 1,000 hours, whereas life expectancy for a piezoelectric fan may be indefinite.

The airflow from an unducted solid-state fan having two opposed, counter-oscillating fan blades is directional but highly turbulent. A single oscillating blade fan also produces directional, turbulent airflow. The fan operates in a quadrature mode of vibration (i.e., vibrating like a diving board with maximum amplitude at the leading edge of each blade) and displaces air through a phenomena known as "vortex shedding." During oscillation of the blades, counterrotating vortices are formed which have substantial angular momentum. The angular momentum is sufficient to prevent an air vortex formed by movement of a fan blade in one direction from counterrotating and being drawn into the vacuum formed behind the blade when the blade direction is reversed. Instead, the first formed vortex is driven away from the reversing blade by the formation of a counter-rotating vortex. The vortices are shed in a direction substantially parallel to the rest position of the blade with a small component of velocity which is transverse to the plane of the blade.

Solid-state fans of the type described above have proven to be particularly useful for cooling components on printed circuit boards. However, in some applications, an airflow is desired which is substantially laminar rather than turbulent. In other applications, a ducted airflow is desired. Therefore, a need exists for a method and apparatus for providing substantially laminar airflow from directional, turbulent fluid flow as generated by oscillating or "flapping" fan blades. A need also exists for efficiently ducting airflow from fans of this type.

DISCLOSURE OF THE INVENTION

It is an object of the present invention to provide a device which produces substantially laminar fluid flow from a pair of counter-oscillating fan blades.

It is also an object of the present invention to achieve the above object without substantially damping blade oscillations, thus preventing oscillation of the blades at a resonant frequency.

It is another object of the invention to efficiently collect airflow from oscillating fan blades into a duct.

It is yet another object of the present invention to provide a laminar flow-producing device which does not interfere with fluid intake to an oscillating fan blade.

The invention achieves these objects, and other objects and advantages which will become apparent from the description which follows, by providing a substantially rectangular duct at a separation distance from the leading edge of the fan blades. It has been found that by providing an external duct to the blades at a preferred gap distance, a maximum efficiency in converting the directional, turbulent fluid flow from the oscillating blade to a uniform, laminar flow can be achieved.

In the preferred embodiment of the invention, the gap distance is related to a maximum leading edge separation distance between two counter-oscillating blades of approximately 6:1. In a single blade fan, the distance between blade leading edge maximum displacements and a preferred gap distance form a ratio of approximately 3:1.

In either preferred embodiment, the duct has a height which is less than the height of the blades to permit inflow of air to the blade at the leading edge corners thereof. The duct also has a width which is less than the maximum leading edge separation distances in either a two blade counter-oscillating fan or a single blade fan. By providing the duct with a width less than the maximum leading edge separation distance of the blade (or blades), airflow around the duct to the back surface of the blade(s) is improved. In this way, air vortices are transferred efficiently from the blade leading edges to the duct and damping of the oscillating blade system is minimized.

In either preferred embodiment, the inside edges of the duct are curved to facilitate capture of turbulent airflow. Top and bottom walls of the duct are curved on the outside edges as well to improve introduction of air into the fan at leading edge corners thereof.

BRIEF DESCRIPTION OF THE DRAWINGS

FIG. 1 is an isometric view of a conventional piezoelectric crystal-driven, solid-state fan of the type having a pair of counter-oscillating fan blades. The drawing diagrammatically illustrates airflow out of and into the fan blades in a steady state condition.

FIG. 2 is a side elevational view of the fan shown in FIG. 1 with a duct of the present invention used therewith.

FIG. 3 is an enlarged, partial top plan view of the fan and duct shown in FIG. 2.

FIG. 4 is an enlarged, isometric view of a rectangular opening formed by the duct.

FIG. 5 is a schematic representation of the fan and duct showing: (a) the fan blades at a minimum separation distance and zero velocity, (b) the fan blades at a rest separation distance and maximum velocity, and (c)

the fan blades at a maximum separation distance and zero velocity.

Figure 6:
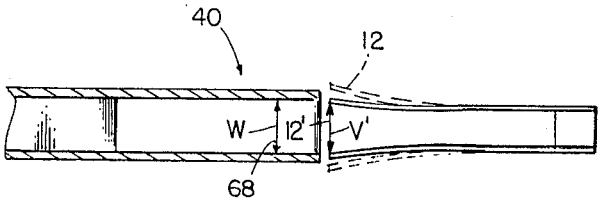

FIG. 6 is a diagrammatic top plan view, similar to FIG. 5, showing the preferred duct width in relation to the blade separation distance at a particular velocity.

Figure 7:
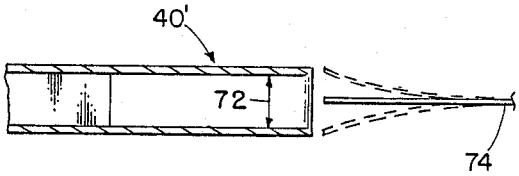

FIG. 7 is a diagrammatic view, similar to FIG. 6, showing a duct having a preferred width in conjunction with a single blade fan.

BEST MODE FOR CARRYING OUT THE INVENTION

A solid-state fan, used for purposes of illustration only in conjunction with the present invention, is generally indicated at reference numeral 10 in FIG. 1. The fan 10 may be of the type that is available from Piezo Electric Products, Inc., of Cambridge, Mass. The fan has a pair of substantially rectangular blades 12 which counter-oscillate in response to a vibrating piezoelectric crystal 14. The crystal is caused to vibrate by a driving circuit 16 which applies an alternating voltage across the crystal at a frequency of approximately 200 Hz. This driving frequency may be adjusted by adjustment of potentiometer 17. The driving frequency is approximately equal to the natural resonant frequency (fundamental frequency) of the blades 12. The blades are driven in quadrature so that leading edges 18 of each blade oscillate with maximum amplitude. Stated another way, the leading edges 18 of each blade are approximately 90° out of phase with root sections 20 of each blade. The root sections are located at nodes established by mechanical connection to the piezoelectric crystal 14.

FIG. 1 also illustrates a steady-state velocity vector diagram for air drawn into and expelled from the fan 10. As can be seen from the figure, during steady-state operation, air is drawn into the fan at root corners 22 and leading edge corners 24. The air is expelled at midsections 26 of the sides and at midsection 28 of the leading edge 18. As shown by the length of velocity vectors, maximum air speed is achieved towards the middle of each midsection and decreases therefrom toward the root and leading edge corners 22, 24.

As shown in FIG. 2, the fan 10 is provided with a duct, generally indicated by reference numeral 40, to collect and convert turbulent airflow from the midsection 28 of the leading edge 18 to substantially uniform, laminar airflow. As best seen in FIG. 4, the duct has a top wall 44 and an opposite, bottom wall 46 which are substantially transverse to a plane defined by the blades. The top and bottom wall are joined by substantially parallel, spaced-apart side walls 48, 50 which together define a rectangular opening 52 for receiving counterrotating air vortices generated by the fan blades 12, with the velocity distribution shown in FIG. 1. The rectangular opening is defined by top, bottom, and side edges 54, 56, 58, and 60. The duct generally tapers to a substantially rectangular duct extension 62 which increases the flow velocity of air in the duct for impingement upon a sensor 64, shown in FIGS. 2 and 3. The sensor may be provided for any number of conventional purposes and is merely included to show one application of the invention. Also, the duct 40 need not taper into a duct having a reduced cross-sectional area. Instead, ducts having a uniform cross-sectional area or even an increasing cross-sectional area may be used. In order to facilitate inflow of air to the leading edge corners, the outsides of top and bottom edges 54 and 56 are rounded. To facilitate introduction of vortices into the rectangular opening 52, the insides of edges 54, 56, 58, 60 are also rounded. Thus, top and bottom edges 54, 56 can be semicylindrical in appearance, whereas side edges 58, 60 are one-quarter cylindrical.

The duct 40 (and duct extension 62) convert the rotating vortices generated by the fan blades 12 into substantially laminar flow within the duct. This is achieved as the rotating vortices interact with the side walls 48, 50 of the duct and lose angular momentum due to friction between the vortices and the walls 48, 50. It is important that the duct have a width which positions the side walls to interact appropriately with the vortices shed from the blades. As shown in FIG. **5*b*, the fan blades have a rest separation distance 66 of approximately 0.15". During oscillation, the blades have a maximum velocity and minimum acceleration in this position. The duct has a width defined by the lengths of the edges 54, 56 which is larger than the rest separation distance 66 of the blades and smaller than the maximum separation distance (approximately 0.30") 70 of the blades. Note that when the blades are in the maximum separation position, as shown in FIG. 5*c*, the blades have a velocity of zero and maximum acceleration, as they do when in a minimum separation position, shown in FIG. 5*a*. It has been found that a preferred duct width 68 of approximately 83% of the leading edge maximum separation distance 70 is preferred. Thus, in the embodiment shown in FIGS. 1–6, where the leading edges of the blades have a maximum separation distance of 0.30", the preferred duct width 68** is approximately 0.25".

FIG. 6 illustrates an alternate preferred method for determining the duct width 68. The dotted line blade position represents the blades at a maximum separation distance, as also shown in FIG. **5*c*. Note that the blades in this dotted line position have zero velocity and maximum acceleration towards the rest position shown in FIG. 5*b*. It has been found that the duct width 68 should be approximately equal to a width 12' between the leading edges 18 of the blades 12 when the instantaneous velocity thereof is approximately 40% of the maximum velocity of the blades, as shown in FIG. 5*b*. In this way, ducts 40** can be constructed with appropriate widths for fans having twin blades of larger or smaller rest separation distances.

FIG. 7 illustrates application of this principle to a single blade oscillating fan. The preferred width 72 of the duct 40' is equal to the leading edge separation distance of the blade 74 between each of two leading edge positions where the blade velocity is approximately 40% of the maximum blade velocity.

As shown in FIG. 2, the duct 40 has a height 80 which is defined by the distance between the top and bottom edges 54, 56 of the duct. The duct height 80 is preferably less than the height 82 of the blades 12. It is preferred that the duct height 80 be approximately 85% of the blade height 82 at the leading edge thereof. This height differential facilitates steady-state airflow into the leading edge corners 24 of the fan 10.

It has been determined that for maximum efficiency in converting rotating air vortices to laminar flow and for capturing the vortices, the width, height and separation distance of blade leading edges from the rectangular opening 52 are important parameters and are related to the blade leading edge velocity.

The duct 40 preferably has the rectangular opening 52, defined by the edges 54–60, spaced at a gap distance 90 from the leading edges 18 of the blades. It has been found that by placing the blade leading edges 18 too close to the rectangular opening (or in the rectangular opening), undesirable damping of the fan blades occurs. This undesirable damping may be significant enough to reduce airflow from the fan blades and prevent resonant operation of the blades. Conversely, if the gap distance 90 is too large, the rectangular opening 52 fails to capture a substantial portion of the air vortices, as the vortices have velocity components directed both towards the opening and transverse thereto. The vortices will also collide with the edges 58, 60 if the gap is too large.

It has been found that the gap distance 90 is related to the maximum leading edge separation distance 70 (FIG. 5*c*) of the blades 12 shown in FIG. 5*c*. For a twin blade system as shown in FIGS. 1–6, the maximum leading edge separation distance and the gap distance should form a preferred ratio of approximately 6:1. In a single blade system such as that shown in FIG. 7, the ratio should be approximately 3:1. With the specific embodiment shown in FIGS. 1–6, wherein the maximum separation distance of the blade leading edges is approximately 0.30", the preferred gap distance is approximately 0.05". These measurements were obtained with a model LP-1200 piezoelectric fan manufactured by Piezo Electric Products, Inc., Advanced Technology Group, 186 Massachusetts Avenue, Cambridge, Mass. 02139. The fan was driven by a 12-volt DC supply voltage at a driving frequency of approximately 200 Hz.

Other variations and embodiments of the invention are contemplated. For example, the invention may be enlarged or reduced in size by following the parameters described above. Therefore, the scope of the invention is not to be limited by the above description but is to be determined in scope by the claims which follow.

I claim:

1. An apparatus for producing substantially laminar fluid flow, comprising:

a pair of flexible, substantially rectangular fan blades, each blade having a leading edge and a leading edge height;

oscillating means for oscillating the blades substantially at a driving frequency so that the leading edges of the blades oscillate between maximum and minimum leading edge separation distances so that the maximum displacement of the blades is at the leading edges, whereby counterrotating fluid vortices are ejected from the blades in a directional, turbulent fluid flow; and a duct defining a duct opening positioned outwardly from the leading edges of the blades at a gap distance sufficiently large to prevent substantial damping of the blade oscillations and sufficiently small to capture a substantial portion of the turbulent fluid flow.

2. The apparatus of claim 1 wherein the maximum leading edge separation distance and gap distance form a ratio of approximately 6:1.

3. The apparatus of claim 2 wherein the oscillating means driving frequency is approximately 200 Hz.

4. The apparatus of claim 2 wherein the maximum leading edge separation distance is approximately 0.30" and wherein the gap distance is approximately 0.05".

5. The apparatus of claim 1 wherein the duct has top and bottom edges curved externally with respect to the duct opening to improve fluid intake over the top and bottom edges of the duct.

6. The apparatus of claim 1 wherein the duct has top, bottom and side edges curved internally with respect to the duct opening to improve introduction to fluid vortices into the duct.

7. The apparatus of claim 1 wherein the duct has a length sufficient to substantially reduce angular momentum of the fluid vortices to produce substantially laminar fluid flow.

8. The apparatus of claim 7 wherein the duct has a decreasing cross-sectional area to increase velocity of the substantially laminar fluid flow.

9. The apparatus of claim 1 wherein the duct has substantially parallel side walls each having a height less than the blade leading edge height to permit substantially unobstructed fluid intake to the fan blades.

10. The apparatus of claim 9 wherein the duct side wall height is approximately 85% of the blade leading edge height.

11. The apparatus of claim 9 wherein the duct side wall height is approximately 1.25" and wherein the blade leading edge height is approximately 1.5".

12. The apparatus of claim 1 wherein the duct has top and bottom edges which define a duct width, the duct width being less than the maximum leading edge separation distance.

13. The apparatus of claim 12 wherein the duct width is approximately 83% of the maximum leading edge separation distance.

14. The apparatus of claim 12 wherein the duct width is approximately equal to a distance between the leading edges of the blades when instantaneous velocity of the blades is approximately 40% of the maximum blade velocity.

15. An apparatus for producing substantially laminar fluid flow, comprising:

a flexible, substantially rectangular fan blade having a leading edge and a leading edge height;

oscillating means for oscillating the blade leading edge between opposite leading edge rest positions so as to define a maximum leading edge separation distance and so that the maximum displacement of the blade is at the leading edge, whereby counterrotating fluid vortices are ejected from the blade in a directional, turbulent fluid flow; and a duct defining a duct opening positioned outwardly from the blade leading edge at a gap distance sufficiently large to prevent substantial damping of the blade oscillations and sufficiently small to capture a substantial portion of the turbulent fluid flow.

16. The apparatus of claim 15 wherein the maximum leading edge separation distance and the gap distance form a ratio of approximately 3:1.

17. The apparatus of claim 16 wherein the maximum leading edge separation distance is approximately 0.15" and wherein the gap distance is approximately 0.05".

18. The apparatus of claim 15 wherein the duct has top and bottom edges curved externally with respect to the rectangular opening to improve fluid intake thereover.

19. The apparatus of claim 15 wherein the duct has top, bottom and side edges curved internally with respect to the rectangular opening to improve introduction of fluid vortices into the duct.

20. The apparatus of claim 15 wherein the duct has a length sufficient to substantially reduce angular momentum of the fluid vortices to produce substantially laminar fluid flow.

21. The apparatus of claim 20 wherein the duct has a decreasing cross-sectional area to increase velocity of the substantially laminar fluid flow.

22. The apparatus of claim 15 wherein the duct has substantially parallel side walls each having a height less than the blade leading edge height to permit substantially unobstructed fluid intake to the fan blades.

23. The apparatus of claim 22 wherein the duct side wall height is approximately 85% of the blade leading edge height.

24. The apparatus of claim 22 wherein the duct side wall height is approximately 1.25" and wherein the blade leading edge height is approximately 1.5".

25. The apparatus of claim 15 wherein the duct has top and bottom edges which define a duct width, the duct width being less than the maximum leading edge separation distance.

26. The apparatus of claim 25 wherein the duct width is approximately 83% of the maximum leading edge separation distance.

27. The apparatus of claim 25 wherein the duct width is approximately equal to a distance between the blade leading edge position when instantaneous velocity of the blade is approximately 40% of the maximum blade velocity.

28. A method for converting directional, turbulent fluid flow from an oscillating fan blade to substantially laminar fluid flow and for efficiently collecting air vortices produced by the fan blade, comprising the steps of:

aligning a substantially rectangular duct having top, bottom and side walls with a substantially rectangular, oscillating fan blade so that the side walls are substantially parallel to the fan blade;

positioning the duct at a predetermined gap distance from a leading edge of the fan blade, the gap distance being sufficiently large to prevent substantial damping of the blade oscillations and sufficiently small to capture a substantial portion of the turbulent fluid flow; and oscillating the blade approximately at a blade resonant frequency so that maximum displacement of the blade is at a leading edge thereof.

29. The method of claim 28 wherein the blade has a leading edge which oscillates between two positions having a maximum separation distance, and wherein the duct and blade leading edge are positioned such that the maximum leading edge separation distance and gap distance form a ratio of approximately 3:1.

30. The method of claim 29 wherein the blade is oscillated such that a leading edge of the blade oscillates between maximum separation distances of approximately 0.15" and wherein the gap distance is approximately 0.05".

31. The method of claim 29 wherein the blade has a fundamental mode of vibration at a fundamental frequency and wherein the blade is oscillated during the oscillating step substantially at the fundamental frequency.

* * * * *